US006943694B1

(12) United States Patent
Ellis

(10) Patent No.: US 6,943,694 B1
(45) Date of Patent: Sep. 13, 2005

(54) BOTTOMING SENSOR

(75) Inventor: John Ellis, Glendora, CA (US)

(73) Assignee: Gaymar Industries, Inc., Orchard Park, NY (US)

( * ) Notice: Subject to any disclaimer, the term of this patent is extended or adjusted under 35 U.S.C. 154(b) by 121 days.

(21) Appl. No.: 10/464,273

(22) Filed: Jun. 18, 2003

Related U.S. Application Data

(60) Provisional application No. 60/392,509, filed on Jun. 27, 2002.

(51) Int. Cl.[7] ..... A47C 27/08; A47C 27/10; G08B 21/00

(52) U.S. Cl. ..... 340/666; 340/591; 340/598; 340/667; 340/626; 200/85 A; 5/713; 5/654; 5/940

(58) Field of Search ..... 5/713, 710, 706, 5/940, 654, 655.3; 340/590, 591, 598, 575, 340/665, 666, 667, 626; 200/85 R, 85 A

(56) References Cited

U.S. PATENT DOCUMENTS 4,694,520 A 9/1987 Paul et al.
4,833,457 A 5/1989 Graebe, Jr.
4,873,737 A * 10/1989 Savenije ..... 5/706
4,949,412 A 8/1990 Goode
5,794,289 A 8/1998 Wortman et al.
6,145,142 A * 11/2000 Rechin et al. ..... 5/706
6,560,804 B2 * 5/2003 Wise et al. ..... 5/713
6,721,980 B1 * 4/2004 Price et al. ..... 5/713

OTHER PUBLICATIONS

European Search Report—3 pages—mailed Oct. 22, 2003.

* cited by examiner

*Primary Examiner*—Alexander Grosz
(74) *Attorney, Agent, or Firm*—Roach, Brown, McCarthy, Gruber, P.C.; Kevin D. McCarthy

(57) ABSTRACT

The present invention is directed to a cushioning device. The present cushioning device has many attributes that are common with many cushions. Some of these common attributes are at least one bladder having a top surface, a bottom surface and at least one side surface positioned between the top and the bottom surfaces. Another common attribute is a bladder cavity being defined by the top surface, the bottom surface and the at least one side surface. The present invention differs from other bladders in that there is a first conductive material and a second conductive material are positioned within the bladder cavity, positioned away from the bottom surface of the bladder, and capable of acting like a switch for a reactive device. The reactive device is electrically interconnected with the first and second conductive materials. When the first and second conductive materials contact each other the reactive device is capable of responding by sounding an alarm and/or re-inflating the bladder cavity with a fluid.

20 Claims, 2 Drawing Sheets

FIG. 1
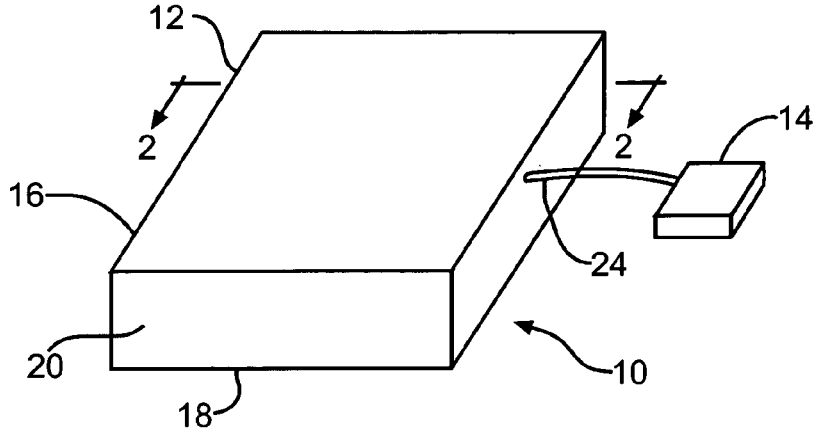
FIG. 2
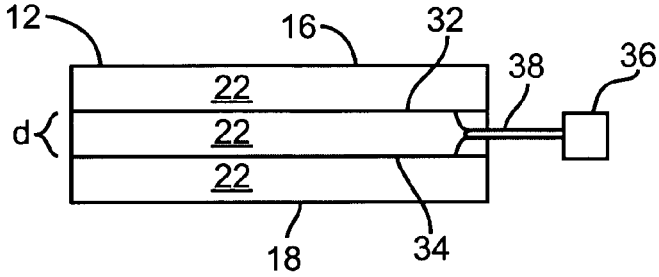
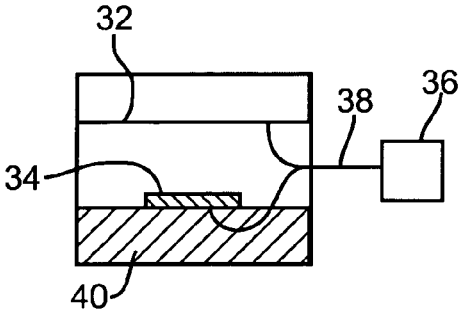
FIG. 3
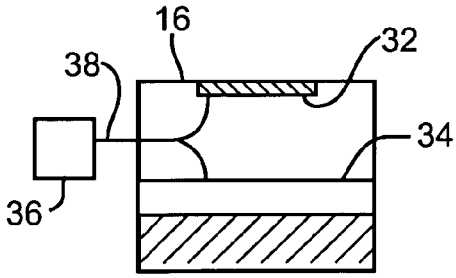
FIG. 4
FIG. 5
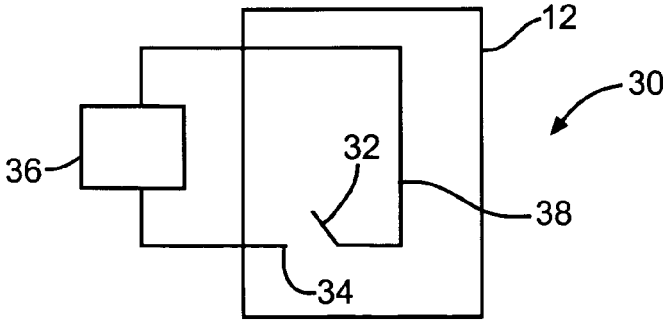

BOTTOMING SENSOR

CLAIM OF PRIORITY

This application claims priority to U.S. provisional patent application Ser. No. 60/392,509 which was filed on Jun. 27, 2002.

FIELD OF THE INVENTION

The present invention relates to a device for sensing and monitoring the position of a patient upon a cushion and for controlling the inflation volume of the cushion.

BACKGROUND OF THE INVENTION

Gaymar Industries, Inc., the assignee of this application, is a manufacturer of cushion like devices. These cushions which have at least one bladder are designed to contain fluids. In many cases the fluid is water and/or air. These cushions are used as seat cushions, mattresses, overlays and any other cushion designed to have a patient positioned thereon. Most of the cushions made by Gaymar are designed for therapeutic purposes.

Inflatable therapeutic cushions for patients have been known for many years. Many therapeutic cushions are designed to reduce "interface pressures"; the pressure encountered between a cushion and a patient's skin positioned on the cushion. It is known that interface pressures can significantly affect the well-being of immobile patients in that higher interface pressures can reduce local blood circulation, tending to cause bed sores and other complications. With inflatable cushions, such interface pressures depend (in part) on the air pressure within the inflatable support cushions.

In U.S. Pat. No. 5,794,289, Wortman et al. describe a cushion having a plurality of air cells (bladders). The cushion rotates a patient by controlling the air pressure in each air cell by inflation and deflation. To rotate a patient to its right side requires deflating the right air cells and inflating the left air cells. The air pressure required to rotate the patient depends on the patient's weight, body type and various other parameters.

The quantity of air pressure that rotates one patient, i.e., 30 degrees may rotate another patient, i.e., 5 degrees. For example, two female patients weigh 130 pounds, one patient is pear-shaped and the other is apple-shaped. The pear-shaped patient rotates 15 degrees with 10 mm Hg while an apple-shaped patient rotates 7 degrees with 10 mm Hg. Obviously each patient is unique and different. Therefore, the programming that controls the air pressure in each cushion must be altered to comply with each patient.

Programming an air pressure cushion unit requires a skilled technician. The skilled technician analyzes each patient and alters the programming to attain the desired air pressure. One method to avoid the expensive technician's analysis and re-programming is to create a self-monitoring mattress.

Previous self-monitoring air pressure cushions have utilized electrical signal transmission devices and electrical signal receiving devices. In one embodiment, the transmission device is a part of the top surface of a bladder and the receiving device is a part of the bottom surface of the bladder. That means the transmission and receiving devices are separated by a bladder cavity. By monitoring the duration of the signal from the transmitter to the receiver, the operator can monitor the size of the bladder. The size of the bladder corresponds to the air pressure and, if desired, the rotation of the patient. Such signal devices are disclosed in U.S. Pat. No. 5,794,289. Those signal devices generate electrical signals, like rf signals, that may, however, adversely effect other medical equipment. In particular, Wortman et al. disclose:

Referring to FIGS. 7 and 8, there is illustrated at 130 an inflatable cushion which is shown to be similar to cushion 44 but may be any other suitable inflatable cushion such as cushions 46 and 116. The cushion 130 is provided with button welds, illustrated at 132, to prevent ballooning thereof. The cushion 130 has upper and lower surfaces 134 and 136 respectively. Cushion inflation is related to the distance between the upper and lower surfaces.

In order to prevent bottoming-out from occurring and to more precisely regulate the cushion inflation, the cushion 130 is inflated so that the distance between the upper and lower surfaces is a predetermined distance. A transmitter coil 138 and a receiver coil 140 are provided adjacent the upper and lower surfaces 134 and 136 respectively, and the distance therebetween, illustrated at 142, is related to the signal strength of a signal transmitted therebetween. Alternatively, the coil 138 may be provided adjacent the lower surface 136, and the coil 140 provided adjacent the upper surface 134.

Illustrated at 141 in FIG. 10 is a transmitter for providing to coil 138 a signal which, as illustrated, may be a sinusoidal A.C. signal or may alternatively be a step-change or pulse signal. The received signal on coil 140 is amplified by a suitable amplifier 144, and the amplified signal sent to a suitable received signal strength indicator (RSSI), illustrated at 146, where a measure of signal strength is provided, in accordance with principles commonly known to those of ordinary skill in the art to which this invention pertains, which is suitably translated into a measure of distance 142 between the coils, which thus indicates whether the cushion is suitably inflated. A pair of resisters 148 are in series with the amplifier 144, and a resister 150 and diode 152 are in parallel with each other and with the amplifier 144. Illustrated at 160 is a suitably connector for lines to the coils 138 and 140. The coils and associated circuitry comprise what may be called an inductive loft sensor.

The RSSI 146 is suitably connected to a low height alarm, illustrated at 147, set for a predetermined low cushion height indicative of bottoming-out of the cushion due to low inflation pressure. The RSSI 146 is also suitably connected to a high height alarm, illustrated at 149, set to a predetermined high cushion height indicative of the patient being out-of-bed. A matrix or array of transmitting and receiving coil assemblies may be provided over the cushion area to provide position as well as height feedback.

In accordance with the present invention, the coils 138 and 140 are embedded within a flexible structure such as between thin plastic flexible sheets 154 and 156 which are suitably attached to each other such as by heat sealing. The sheets 154 and 156 may be said to comprise a generally rectangular blanket 158 with the coils 138 and 140 embedded in opposite halves of the blanket 158. The coils are spaced apart (in the plane of the unfolded blanket) a distance, illustrated at 131, equal to at least the maximum thickness of the inflated cushion 130. The blanket 158 is applied by folding it about the cushion so that one coil 138 is adjacent the upper surface 134 and the other coil 140 is adjacent the lower surface 136. Snaps, illustrated at 162, spaced along opposite terminal end edges of the blanket 158 or other suitable means are provided for suitably holding the blanket 158 in place on the cushion 130.

The system of the '289 patent does have some potential problems. One of those problems is that the transmission of the electrical signal may interfere with medical devices. Thus, there is a need to have a self-monitoring air volume cushion that monitors, without causing any possible adverse effect (transmitting rf transmissions) on other medical equipment, the bladder size to determine when to inflate a particular bladder to prevent bottoming and/or excess pressure.

An alternative, and for the most part non-transmitting self-monitoring air volume cushion device was disclosed in U.S. Pat. No. 6,145,142. In that patent (assigned to Gaymar Industries, Inc.), Rechin et al. disclosed a cushion having "at least one inflatable cushion having a pair of sides, and at least one set of an electromagnetic energy emitting device and an electromagnetic energy receiving device. The electromagnetic energy emitting device, when operating, illuminates the interior of the inflatable cushion. The electromagnetic energy receiving device collects the illuminating energy. The operation of the mattress requires a means for measuring the optical aperture of the inflatable cushion. The measuring means determines the optical aperture of the inflatable cushion by measuring the quantity of illuminating energy collected by the electromagnetic energy receiving device when the electromagnetic energy emitting device illuminates the interior of the inflatable cushion." That device is interesting but it has never been incorporated into a publicly available cushion system made by Gaymar Industries, Inc.

In any case, both of those Gaymar patents illustrate that controlling the air in a cushion is desirable to prevent bottoming and prevent excess pressure being applied to the patient.

"Bottoming" refers to any state where the upper surface of any given cushion is depressed to a point that it contacts the lower surface, thereby markedly increasing the interface pressure where the two surfaces contact each other. Prior to bottoming occurring, the pressure exerted by the bladder on the skin of the object becomes excessive.

These bottoming sensors are acceptable but Gaymar has been seeking to improve such sensors. The improvements are made for numerous reasons. Some of these reasons are and not limited to cost (inexpensive), reliability, easy to install and adjust the system, and simplicity. In addition, the bottoming sensor should be able to diminish the chance of bottoming out and also decrease the chance that the cushion will exert too much pressure to the patient. All of these goals are accomplished with the present invention.

SUMMARY OF THE INVENTION

The present invention is directed to a cushioning device. The present cushioning device has many attributes that are common with many cushions. Some of these common attributes are at least one bladder having a top surface, a bottom surface and at least one side surface positioned between the top and the bottom surfaces. Another common attribute is a bladder cavity being defined by the top surface, the bottom surface and the at least one side surface. The present invention differs from other bladders in that there is a first conductive material and a second conductive material are positioned within the bladder cavity, positioned away from the bottom surface of the bladder, and capable of acting like a switch for a reactive device. The reactive device is electrically interconnected with the first and second conductive materials. When the first and second conductive material contact each other the reactive device is capable of responding by sounding an alarm and/or re-inflating the bladder cavity with a fluid.

BRIEF DESCRIPTION OF THE FIGURES

FIG. 1 is a view of the present invention.

FIG. 2 is a cross sectional view of FIG. 1 taken along the lines 2—2.

FIGS. 3–4 are alternative embodiments of FIG. 2.

FIGS. 5 and 6 are electrical schematics of FIGS. 2–4 and 9.

DETAILED DESCRIPTION OF THE INVENTION

Figure 6:
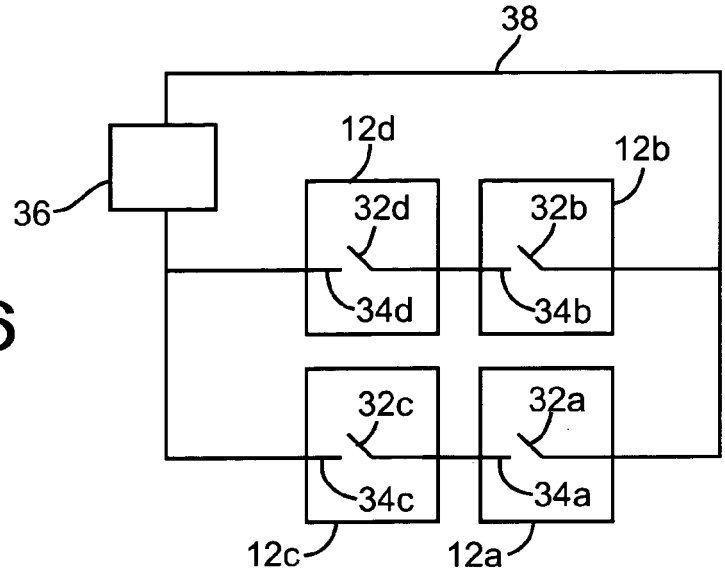

The present invention as shown in FIG. 1 has at least one inflatable cushion 10 having at least one bladder 12. The bladder 12, in at least one embodiment of the present invention, is interconnected to a pump 14 as shown in FIG. 1. The pump 14 provides a fluid to the bladder 12. The fluid can be a gas or a liquid. If a gas is used, the preferred gas is air. And if a liquid is used, the preferred liquid is an aqueous solution, preferably non-ionic.

The bladder 12 can be made of polymeric materials having a top surface 16 capable of receiving an object, a bottom surface 18 that is opposite the top surface, and at least one side 20 positioned between the top and the bottom surfaces. The top surface 16, the bottom surface 18, and the at least one side 20 define the perimeter of a bladder cavity 22, as illustrated in FIG. 2. The bladder cavity is designed to contain the fluid.

Every inflatable bladder is capable of receiving through an inlet 24 a fluid from a fluid source, normally the pump 14. From this fundamental understanding of inflatable bladders, the variations of the bladders become evident. For example, some bladders (1) have the inlet 24 of the fluid removed to become a self-contained device, and (2) retain an inlet 24 to receive fluid to become a dynamic device.

In the latter embodiment, the fluid exits the bladder through at least one outlet (not shown). In one version, the fluid exits the outlet through a conduit to return to the fluid source. In other versions the fluid exits the outlet through a conduit to a receiving unit, distinct from the fluid source. Another version has the surface of the bladder having a plurality of apertures designed to release at least a portion of the fluid toward the object positioned on the inflatable bladder. Some bladders may also have a CPR dump system to release the fluid expeditiously from the bladder.

Obviously there may be alternative embodiments to these generic descriptions of bladders. In addition, the bladders may have alterations to (1) generate desired fluid flow patterns, (2) obtain desired cushion firmness and (3) allow the bladder adaptability for the cushion system. To obtain such results and others like it, the bladders have predetermined button welds, welds, and slits along welds. In addition, many of these alternative embodiments are embodiments in numerous patent applications, issued patents, and product configurations.

As previously stated, numerous, if not all, inflatable bladders are constructed of some type of film material. The film material can be, for example, vinyl, polyethylene, nylon, or combinations thereof. These materials may be treated to be electrically conductive in some embodiments of the present invention. When such film materials are used, the applicants have determined that the bladder will eventually bottom out without monitoring the bladder size.

This invention is directed to monitoring the bladder size to diminish the chance of (1) bottoming out and (2) the bladder exerting too much pressure to the patient. This is accomplished by inserting a flexible switch system 30 into at least a portion of a bladder 12, as shown in FIGS. 2–6.

The flexible switch system 30 has a portion positioned outside the inflatable cushion 10 and another portion positioned within the bladder cavity 22. Generically, the switch system 30 has a first conductive material 32, at least a second conductive material 34, a reaction device 36, and at least one wire 38 interconnected to the two conductive materials 32, 34, and the reaction device 36, as shown in the electrical schematics of FIGS. 5 and 6. Preferably, the conductive materials 32, 34 are the same material but each can be different materials.

The conductive materials 32, 34 are positioned within the bladder cavity 22. The conductive material 32, 34 can be any material that is capable of (1) being attached to a surface 16, 20 of the bladder 12 or an object 40, like foam, within the bladder cavity 22, as illustrated in FIGS. 2–4; and (2) making an electrical connection when the first and second conductive material 32, 34 contact each other when the bladder 12 is closing in on bottoming out and/or exerting too much pressure on the patient. The conductive materials 32, 34 are not attached to the bottom surface 18 because then the bladder has bottomed out and excess pressure has already been exerted on the object. The conductive materials 32, 34 are preferably conductive flexible material.

The attachment of the conductive materials 32, 34 can occur by any conventional attachment means, and is not limited to welding, sonic welding, adhesives, rivets, buttons, hook and loop systems, webbing, and/or combinations thereof. In some embodiments, at least one of the conductive materials can be positioned on another object, like a foam material, in at least a portion of the bladder cavity 22.

The conductive materials 32, 34 are separated from each other by a distance d when the switch system is in the open position, as illustrated in FIGS. 2–6. The switch system 30 is in the open position when no object is on the cushion 10 and when the cushion 10 does not exert too much pressure to the object positioned on the cushion 10. The switch system remains in the open position as well if the cushion is overfilled with fluid.

Figure 7:
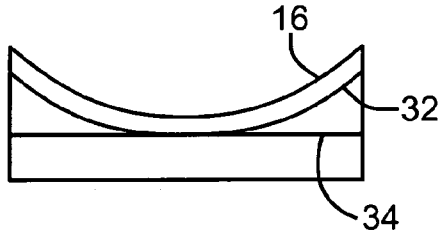
FIG. 7 is an alternative embodiment of FIG. 2 when the switch is closed.
Figure 8:
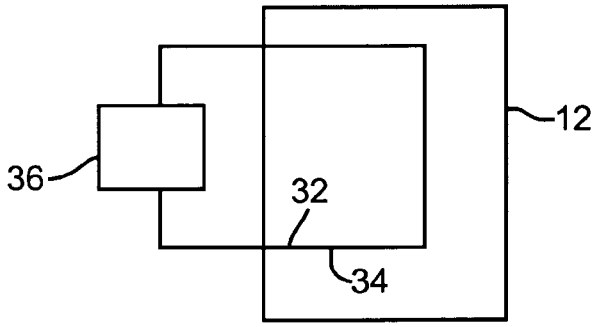
FIG. 8 is an electrical schematic of FIG. 7.

When the conductive materials 32, 34 contact each other, the cushion 10 is beginning to exert too much pressure to the object. Hence, the cushion 10 needs to be removed and/or re-inflated to prevent (1) further excess pressure to the object and/or (2) bottoming out. An illustration of this position is shown in FIGS. 7 and 8, which are corresponding diagrams of the same event.

If the cushion 10 is a self-contained device that cannot be re-inflated, the switch system 30 has a reaction device that is an alarm. The alarm can be any type of device that indicates to a user and/or third party when a particular cushion 10 has to be removed.

Figure 9:
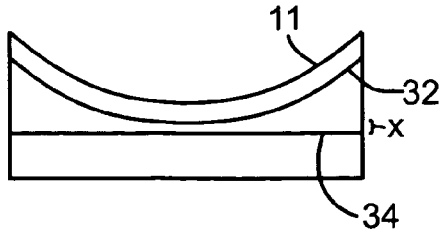
FIG. 9 is an alternative embodiment of FIG. 2.

If the cushion 10 is a dynamic device, the switch system 30 has a reaction device that is interconnected to a microprocessor in the fluid source 14. The fluid source 14 receives the signal that a particular bladder (or set of bladders 12*a–d*) requires re-inflation. In a preferred embodiment, the fluid source 14 provides fluid to the bladder cavity 22 of the particular bladder(s) 12 until the conductive materials 32, 34 are separated, preferably just separated. It has been determined that when the conductive materials 32, 34 are just separated (measure x) as illustrated in FIG. 9, the cushion 10 applies the desired pressure to the object. Thereby, the object receives the maximum therapy. In some cases, it may be desired to have the conductive materials 32, 34 contact each other and then re-inflate the bladder 12, in a dynamic system, to the maximum therapy position.

From this fundamental understanding, the present invention can be used in parallel circuits or series circuits. Parallel circuitry is useful for cushion systems that have a plurality of cushions (for example 12*a*–d) in alternating pressure mode—one set of bladders inflated and the other set is deflated.

It can also be appreciated that possibly having two bladders 12 adjacent to each other provides a more accurate reading to the reactive device 36.

It is also appreciated that these sensors can be positioned only in those bladders that are expected to receive the majority of the object's weight. For example, if the cushion was used as a mattress, the sensors could be limited to the pelvis region of the bladders.

It is also understood that if a CPR dump was enacted, the switch system 30 would be automatically deactivated. Once the CPR dump situation was resolved, the switch system 30 would be reactivated.

While the preferred embodiment of the invention has been illustrated and described, it will be clear that the invention is not so limited. Numerous modifications, changes, variations, substitutions and equivalents will occur to those skilled in the art without departing from the spirit and scope of the present invention as defined by the appended claims.

I claim:

1. A cushioning device comprising at least one support bladder having a top surface, a bottom surface and at least one side surface positioned between the top and the bottom surfaces and the at least one support bladder is capable of being independent from other bladders;

a bladder cavity being defined by the top surface, the bottom surface and the at least one side surface;

a first conductive material and a second conductive material are positioned within the bladder cavity, positioned away from the bottom surface of the bladder, and capable of acting like a switch for a reactive device;

the reactive device is electrically interconnected with the first and second conductive materials; when the first and second conductive materials contact each other the reactive device is capable of responding by sounding an alarm and/or re-inflating the bladder cavity with a fluid.

2. The cushioning device of claim 1 wherein the reactive device is a pump.

3. The cushioning device of claim 1 wherein the fluid is a gas.

4. The cushioning device of claim 1 wherein the fluid is a liquid.

5. The cushioning device of claim 1 wherein the re-inflating the bladder cavity with a fluid is maintained until the first and second conductive materials are separated.

6. The cushioning device of claim 1 wherein the first conductive material is a flexible conductive material.

7. The cushioning device of claim 1 wherein the second conductive material is a flexible conductive material.

8. The cushioning device of claim 1 wherein the reactive device is interconnected in series to at least a second set of first and second conductive materials in a second bladder.

9. The cushioning device of claim 1 wherein the reactive device is interconnected in parallel to at least a second set of first and second conductive materials in a second bladder.

10. The cushioning device of claim 1 wherein the reactive device is interconnected (A) in series to at least a second set of first and second conductive materials in a second bladder, and (B) in parallel to at least a third set of first and second conductive materials in a third bladder.

11. A method of using a cushioning device having (a) at least one support bladder having a top surface, a bottom surface and at least one side surface positioned between the top and the bottom surfaces and the at least one support bladder is capable of being independent from other bladders; (b) a bladder cavity being defined by the top surface, the bottom surface and the at least one side surface; (c) a first conductive material and a second conductive material are positioned within the bladder cavity, positioned away from the bottom surface of the bladder, and capable of acting like a switch for a reactive device; (d) the reactive device is electrically interconnected with the first and second conductive materials;

placing an object on the cushioning device;

allowing the cushioning device to deflate until the first and second conductive material contact each other which results in the reactive device respond by sounding an alarm and/or re-inflating the bladder cavity with a fluid.

12. The method of claim 11 wherein the reactive device is a pump.

13. The method of claim 11 wherein the fluid is a gas.

14. The method of claim 11 wherein the fluid is a liquid.

15. The method of claim 11 wherein the re-inflating the bladder cavity with a fluid is maintained until the first and second conductive materials are separated.

16. The method of claim 11 wherein the first conductive material is a flexible conductive material.

17. The method of claim 11 wherein the second conductive material is a flexible conductive material.

18. The method of claim 11 wherein the reactive device is interconnected in series to at least a second set of first and second conductive materials in a second bladder.

19. The method of claim 11 wherein the reactive device is interconnected in parallel to at least a second set of first and second conductive materials in a second bladder.

20. The method of claim 11 wherein the reactive device is interconnected (A) in series to at least a second set of first and second conductive materials in a second bladder, and (B) in parallel to at least a third set of first and second conductive materials in a third bladder.

* * * * *